US006997761B2

(12) United States Patent
Lutsch et al.

(10) Patent No.: US 6,997,761 B2
(45) Date of Patent: Feb. 14, 2006

(54) ELECTRICAL CONTACT ELEMENT

(75) Inventors: Harald Michael Lutsch, Weiterstadt (DE); Ranko Resman, Zagreb (HR); Mario Lekic, Zagreb (HR); Dean Popovic, Zagreb (HR)

(73) Assignee: Yazaki Europe Ltd., Hertfordshire (GB)

( * ) Notice: Subject to any disclaimer, the term of this patent is extended or adjusted under 35 U.S.C. 154(b) by 0 days.

(21) Appl. No.: 10/968,887

(22) Filed: Oct. 21, 2004

(65) Prior Publication Data

US 2005/0118884 A1 Jun. 2, 2005

(30) Foreign Application Priority Data

Oct. 22, 2003 (DE) ..... 103 49 539

(51) Int. Cl.
*H01R 13/02* (2006.01)

(52) U.S. Cl. ..... 439/891; 439/866

(58) Field of Classification Search ..... 439/109, 439/741, 744–746, 806, 834, 865, 866, 872, 439/877, 879, 882, 889
See application file for complete search history.

(56) References Cited

U.S. PATENT DOCUMENTS 3,275,973 A * 9/1966 Shlesinger, Jr. ..... 439/872
5,445,541 A 8/1995 May et al.
5,989,079 A * 11/1999 Seko et al. ..... 439/884

FOREIGN PATENT DOCUMENTS

| | | |
|---|---|---|
| DE | 42 00 109 A1 | 7/1993 |
| DE | 42 44 776 C2 | 3/1996 |
| DE | 19922560 A1 | 11/2000 |
| DE | 201 04233 U1 | 7/2001 |
| EP | 0 821 435 B1 | 6/2003 |

* cited by examiner

*Primary Examiner*—Tho D. Ta
*Assistant Examiner*—Vanessa Girardi
(74) *Attorney, Agent, or Firm*—Sughrue Mion, PLLC

(57) ABSTRACT

An electrical contact element including a base element (1) formed from a flat material with a high electrical conductivity and includes a conductor contact portion (2), a base portion (4) integrally connected to the conductor contact portion (2) and formed box-like defined by an upper wall (5) with an opening (6), a bottom wall (7) arranged opposite to the upper wall (5) and two side walls (8, 9) connecting the upper wall (5) and the bottom wall (7), and a flat terminal pin (16) integrally connected to the base portion (4) and extending away from the conductor contact portion (2) and having two vertically arranged pin portions **(17*a*, 17*b*). The contact element also includes an elastic retaining element (18) formed from a sheet spring steel and including a flat pin-reinforcement portion (19) arranged between the two pin portions (17*a*, 17*b*), an intermediate portion (20) extending from the pin-reinforcement portion (19) and abutting an inner side of the bottom wall (7), and an elastic retaining portion (21) angled relative to the intermediate portion (20) and projecting out of the opening (6) and forming a support edge (23)**.

11 Claims, 6 Drawing Sheets

ELECTRICAL CONTACT ELEMENT

BACKGROUND OF THE INVENTION

The invention relates to an electrical contact element and, especially, such a contact element which has especially small dimensions and is provided with a flat terminal pin, which, for example, has a width of 1.2 mm and a thickness of in total 0.64 mm. Such electrical contact elements are, for example, used for connecting electrically operated components or electronic components in a vehicle.

Several of such contact elements are accommodated in a housing of a connector. The housing has accommodation chambers, which are arranged next to each other or above each other, respectively, in a specific pattern and accommodate a contact element, respectively. In this case, the contact element has to be secured against withdrawal. The retainment has also to be able to take up the connection forces acting on the contact elements.

EP 0 821 435 B1 (U.S. Pat. No. 5,989,079) describes an electrical contact element. This comprises a base element, made from a sheet material with a good electrical conductivity. The base element has a conductor contact portion, which comprises, for example, a crimping tab, serving to connect a conductor of a cable or an insulation of the cable, respectively. A base portion, formed box-like in cross-section, follows integrally the conductor contact portion. This base portion comprises an upper wall, arranged opposite to a bottom wall. Furthermore, the upper wall and the bottom wall are connected to each other by two side walls. A flat terminal pin is connected integrally to the base portion and extends away from the conductor contact portion. This flat terminal pin comprises two pin portions arranged one above the other. A material portion projects from the upper wall of the base portion in the direction towards the end portion of the terminal pin, connected to the base portion, which material portion is formed integrally with the base portion and engages between the two opposed pin portions. Thus, a root area, i.e. the area of the flat terminal pin attached to the base portion, should be reinforced. The two pin portions and also the reinforcement portion are made from the same material, namely from a material with a good electrical conductivity.

The base portion is enclosed by a cover, formed also box-like and known also as a locking spring. This is made from a non-corrosive steel and has a lance-like portion, forming an elastic retaining element. This contact element is, for example, accommodated in a contact element accommodation chamber of a housing of a connector and is retained in the same by this lance-like portion by means of engaging behind a projection in the contact element accommodation chamber. A cover in form of a locking spring, enclosing the base element, leads to enlarged dimensions and therefore, to larger distances of the contact element accommodation chambers. Furthermore, by means of the reinforcement no improvement of the strength of the flat terminal pin in the direction to its free end is achieved, as no support is given in this area. Also the material, which is used for the intermediate layer, is relative soft. It consists of a copper material, having a good electrical conductivity.

A miniaturized electrical contact element is, for example, described in DE 42 44 776 C2. The contact element comprises a base element with a conductor contact portion and an insulation crimping portion for the connection to an electrical cable or, respectively, to a conductor thereof, which can, for example, consist of a multitude of individual conductors. The base element comprises further an intermediate portion formed U-like and, further, connected integrally thereto a flat terminal pin. This flat terminal pin is formed of two above each other arranged pin portions. The base element is punched from an electrical conductive sheet. The punched part is then formed such that a flat terminal pin is formed, in which the two pin portions are arranged on top of each other and are press-connected. Hereby, the conductor contact portion and also the insulation crimping portion as well as the base portion are brought into the above described U-shape. The base portion is enclosed by a box-like retaining element in form of a locking spring, which is retained form fittingly on the same. Furthermore, retaining spring arms bent towards the outside, are punched out at the two opposed side walls of the locking spring by means of punching out a U-like cut. The retaining spring arms project over the side walls to the outside. The locking spring is made from an elastic material which is stronger in relation to that of the base element, for example, is made from steel. The retaining spring arms serve to retain the contact element in the corresponding accommodation chamber of a connector housing, i.e. to retain it against withdrawal. The construction with a U-like base element and a box-like locking spring enclosing the same, has the disadvantage, that the dimensions in the cross-section are enlarged. Therefore, the distances of the accommodation chambers, i.e. the pattern dimension, have to be formed correspondingly large in a connector housing. There is, however, the requirement, to further decrease the pattern dimension and therewith, to be able to accommodate more contact elements in a predetermined space in a connector housing.

DE 201 04 233 U1 relates to an electrical contact element, made from a punched sheet part and having a contact in the form of a terminal pin as well as a crimping portion as a conductor contact portion. The terminal pin is arranged to a so-called box-like locking spring, which has a lance for the retainment of the contact element in a housing.

DE 42 00 109 A1 (related to U.S. Pat. No. 5,445,541) relates to a contact element with a conductor contact portion in form of crimping tabs and a support body portion attached thereto, for the axial retainment of the contact element in a connector housing. The flat terminal pin consists of two above each other arranged pin portions, which are bent starting from a punched sheet part in such a way, that they cover each other. Between the conductor contact portion in form of crimping tabs and the contact portion formed as a flat terminal pin, the support body is arranged, which is formed by tabs. This support body is engaged behind by a projection on the connector housing in the assembled condition. This projection is part of a locking arm, formed on the connector housing in an elastic manner.

DE 199 22 560 A1 describes a contact element, which comprises a base portion formed integrally with a conductor contact portion. On the base portion a separately manufactured terminal pin made from a solid material can be attached. For this, it has a correspondingly formed connection portion. Additionally, a retaining element in form of a box-like locking spring is provided, which encloses the base portion and has a lance-like and elastic retaining portion, forming a support edge. The terminal pin is solid and has in cross-section a square portion. The base element together with the integrally formed-on contact portion and the terminal pin separated therefrom are, preferably, manufactured from a copper alloy. The retaining element in form of a fixing sleeve arranged thereto, can be used to additionally stabilize the connection of the terminal pin with the base element.

SUMMARY OF THE INVENTION

From this, the object of the invention results, to provide a contact element which cross-section is formed smaller concerning the portion to be accommodated in an accommodation chamber and on which, besides of the reduction of the dimensions, a stable flat terminal pin is formed.

This object is solved according to the invention by an electrical contact element, comprising a base element, which is formed from a flat material with a high electrical conductivity, has a conductor contact portion, has a base portion, integrally connected to the conductor contact portion and formed box-like and which has an upper wall with an opening, and a bottom wall arranged opposite to the upper wall as well as two side walls connecting the upper wall and the bottom wall, and has a flat terminal pin, integrally connected to the base portion and ex-tending away from the conductor contact portion and comprising two above each other arranged pin portions, and an elastic retaining element, which is formed from a sheet spring steel, has a flat pin-reinforcement portion, arranged between the two pin portions, has an intermediate portion, starting from the pin-reinforcement portion and abutting an inner side of the bottom wall, and has an elastic retaining portion angled relative to the intermediate portion and projecting out of the opening and forming a support edge.

As the retaining element is formed strip-like and is arranged in the base element, the outer dimensions of the contact element can be reduced, i.e. the box-like cross-section can be formed in total smaller. The base element is, preferably, punched from a sheet material and is bent into its shape. The retaining element provided for retaining the contact element, is still made from a steel, so that the necessary elastic characteristics are achieved and it provides, further, the necessary retainment security against withdrawal from a connector housing. By means of the smaller dimensions, the pattern dimensions, with which such miniaturized contact elements can be arranged, can be reduced compared to the embodiments according to the State of the Art. A further advantage is that also the area of the flat terminal pin is reinforced as a whole by the pin-reinforcement portion of the retaining element accommodated between the pin portions made from an electrical conductive material. The material, from which the retaining element is manufactured, has to have a higher strength than the material from which the base element is manufactured. But it has not to be manufactured necessarily from a spring steel, when the requirements are correspondingly.

Thus, during the repeated connecting and detaching of connectors, having a multitude of such contact elements, especially the danger, that one of the contact elements is bent, is significantly reduced. If the base element is made from a copper material, the danger of deforming the flat terminal pin with the dimensions existing in miniaturized contact elements is significantly reduced.

In an embodiment of the invention it is provided, that the two side walls connected, respectively, to both sides of the bottom wall of the base portion are respectively provided with a retaining tab projecting therefrom, wherein the retaining tabs project into the space delimited by the bottom wall, the side walls and the upper wall and engage over the intermediate portion of the retaining element which intermediate portion abuts the inner face of the bottom wall.

By means of this measurement it is achieved, that the spring stiffness of the retaining element is improved. The free elastic length of the retaining element is, thus, reduced. Preferably it is provided, that the retaining element is angled following the pin-reinforcement portion in the direction towards the upper wall and is again angled thereto in the area of the opening, so that the support edge of the retaining portion projects outwards beyond the upper wall.

In an improvement of this embodiment it is provided, that a retaining lance is punched out of the bottom wall, which is arranged opposite to the first angled portion extending in the direction towards the upper wall. Thus it is achieved in connection with the angled version, that the retaining element is secured along the longitudinal axis against displacement.

Further it is provided, that the upper wall has a support tab projecting into the space delimited by this upper wall, the side walls and the bottom wall. Thus it is achieved, that when pulling the cable attached to the contact element a secure support is achieved, as the second angled portion can be supported in the angled area on the support tab, so that the danger does not exist, that the second portion used for the retainment can be deformed.

For increasing the stiffness of the retaining element, a bead is provided in the area of the intermediate portion and of the first angled portion.

Preferably, the base element is manufactured from a copper material with a high electrical conductivity, as it is, for example, given with the material CuSnO 15. As a material for the retaining element, especially a non-corrosive steel with a high strength, for example X12CrNi177K1500, can be used.

A preferred embodiment of the invention is schematically shown in the drawing and is described in detail by means of it.

DETAILED DESCRIPTION OF THE INVENTION

Figure 1:
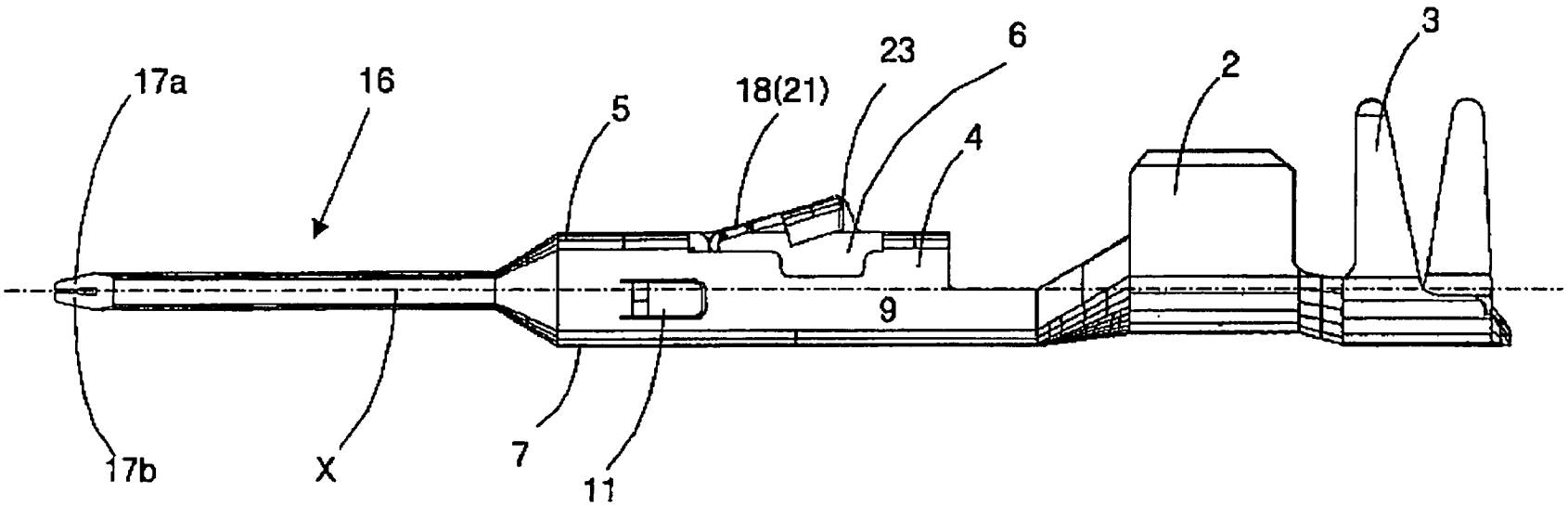
FIG. 1 a side view of the electrical contact element.
Figure 2:
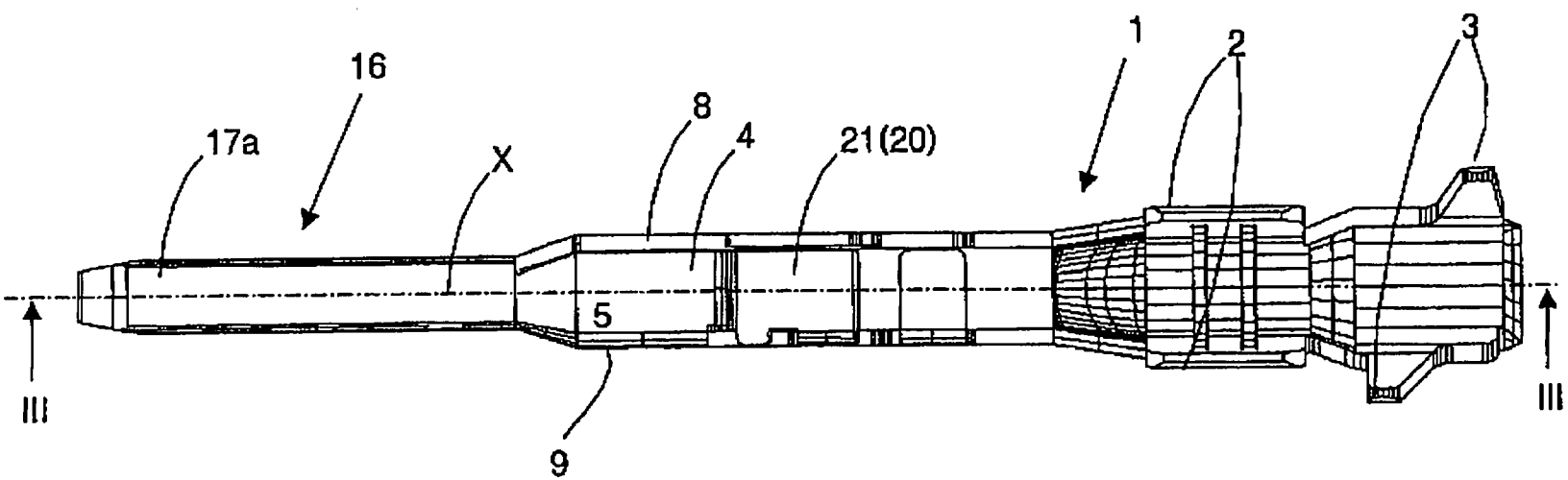
FIG. 2 atop view of FIG. 1.
Figure 3:
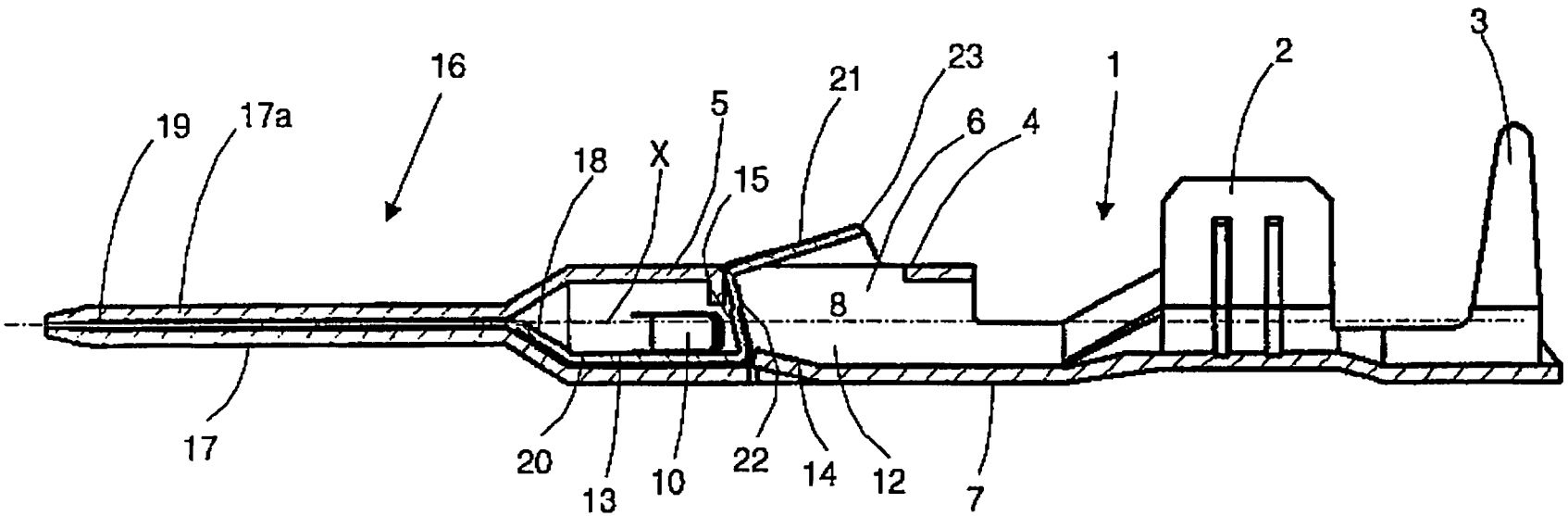
FIG. 3 a longitudinal sectional view III—III of FIG. 2.
Figure 4:
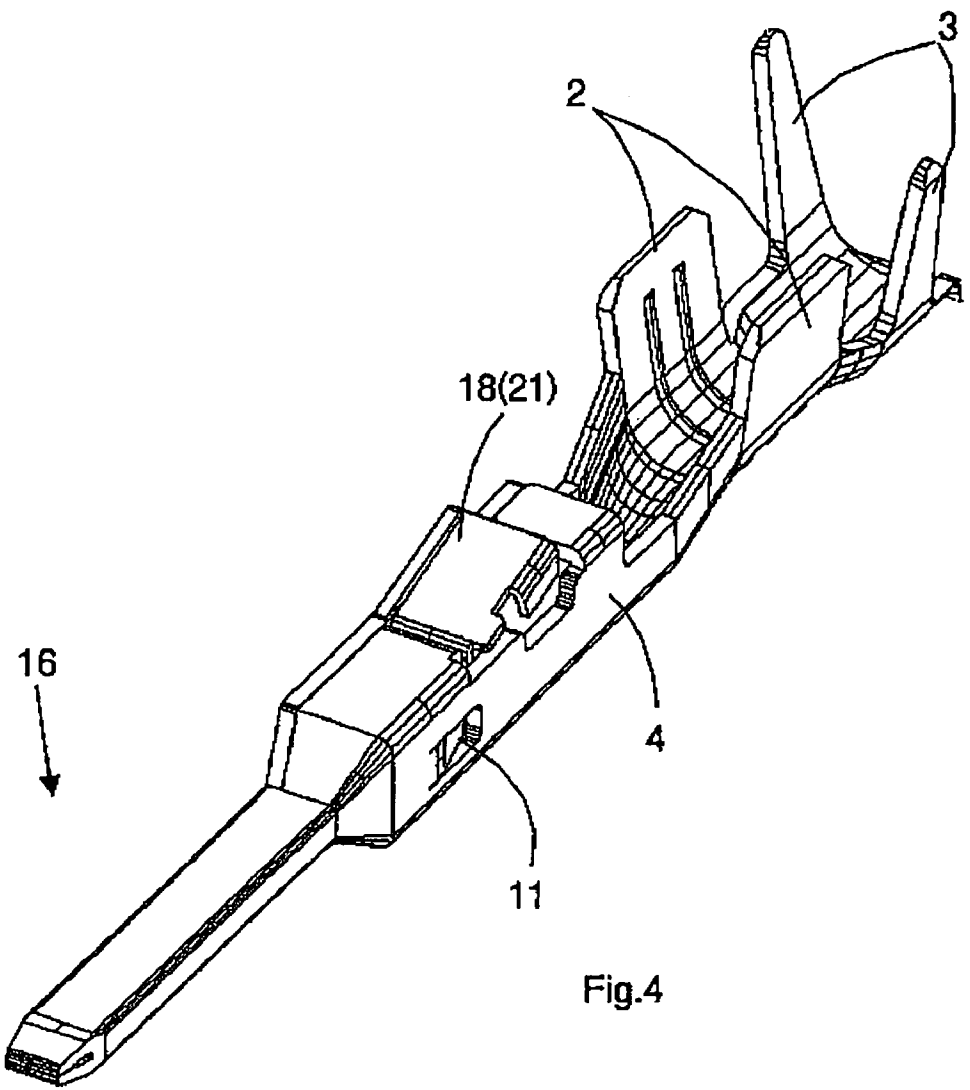
FIG. 4 a perspective view of the contact element.

From FIGS. 1 to 4 an electrical contact element is visible, comprising a base element 1, formed from a copper material, especially a copper sheet by means of punching and bending. The base element 1 comprises a conductor contact portion 2 in form of two tabs and an insulation crimping portion 3, which also comprises two tabs. In this area, the base element 1 has essentially a U-like cross-section, which is especially visible from FIG. 4. In this portion an electrical cable (not shown) is received. More specifically, the two tabs of the conductor contact portion 2 are connected to the conductor of the cable by crimping. The two tabs of the insulation crimping portion 3 are crimped to the insulation of the cable, so that the cable is retained. The two conductor contact portions 2 serve to secure a sufficient electrically conductive contact between the base element 1 of the contact element and the conductor of the cable.

A base portion 4 follows the conductor contact portion 2 with a transitional portion. The base portion 4 of the base element 1 is formed box-like. A hollow rectangular cross-section is formed, wherein the upper wall 5 has an opening 6 in form of a window. The upper wall 5 delimits together with the bottom wall 7 and the two side walls 8, 9 a space 12. The side walls 8, 9 connect the bottom wall 7 to the upper wall 5. In the two side walls 9, 10, respectively, a U-like cut is provided, so that, respectively, a retaining tab 10 or 11 is formed. The retaining tabs 10, 11 are bent from the side walls 9, 10 in such a way, that they project with their free ends into the space 12. Furthermore, as especially visible in FIG. 3, in the area of the face of the opening 6, distanced to the conductor contact portion 2, a support tab 15 is bent substantially at a right angle out of the upper wall 5 in such a way, that it also projects into the space 12 towards the longitudinal axis X.

Along the longitudinal axis X the base portion 4 is followed by a flat terminal pin 16 connected integrally to this and which is formed from two flat pin portions 17*a*, 17*b*, which cover each other (which are arranged above each other). The flat terminal pin 16 follows the base portion 4 with a transition. The flat terminal pin 16 has, for example, a thickness of 0.64 mm and a width of 1.2 mm. It is made, as it is integrally connected to the base portion 4 and the conductor contact portion 2 and as it is bent from a punched sheet part, from the same conductive material, for example copper. Here, the two pin portions 17*a*, 17*b* are connected to each other at a longitudinal edge. They are bent such, that they are arranged with a distance in-between above each other.

Figure 5:
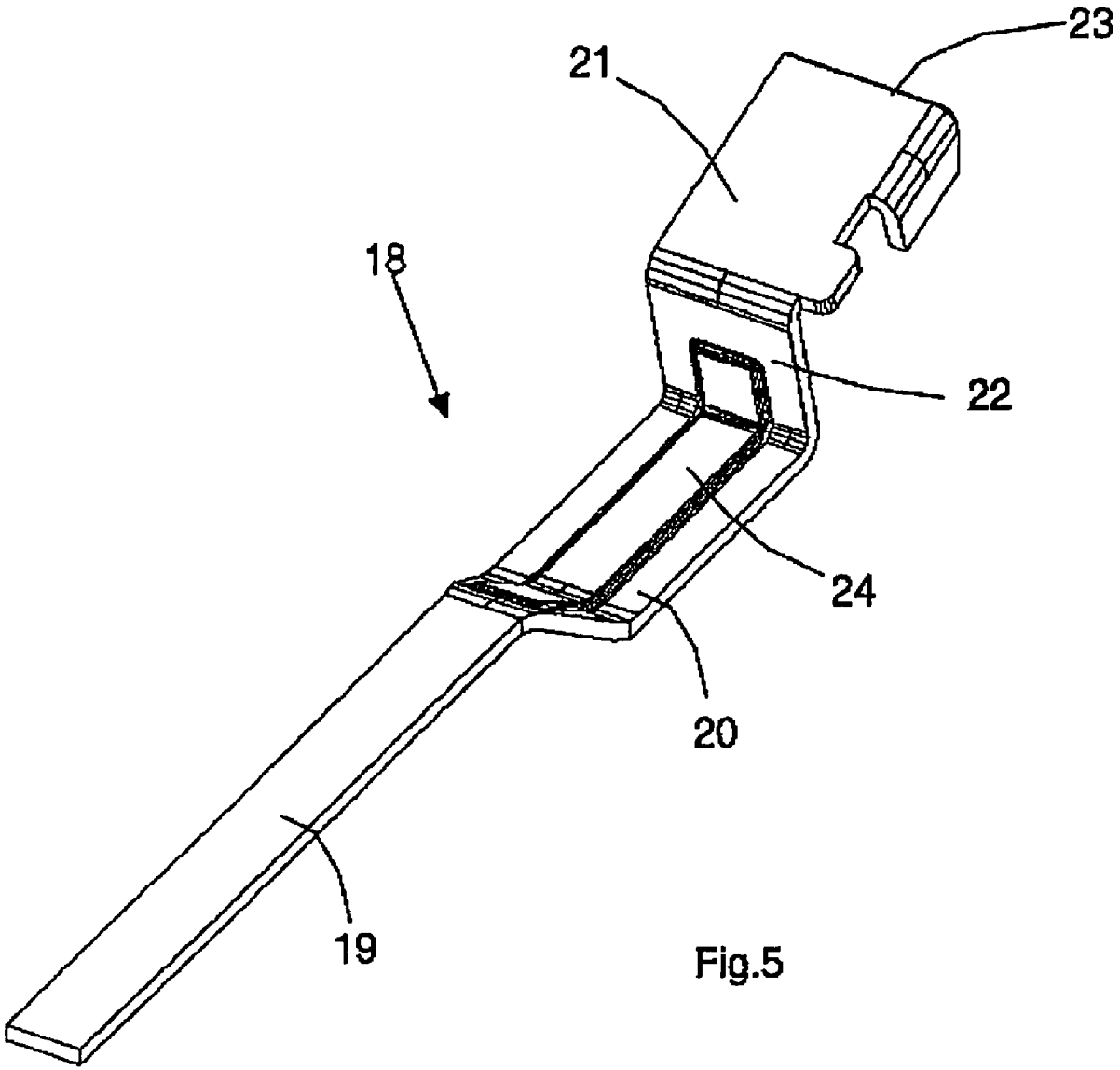
FIG. 5 a perspective view of the retaining element.
Figure 6:
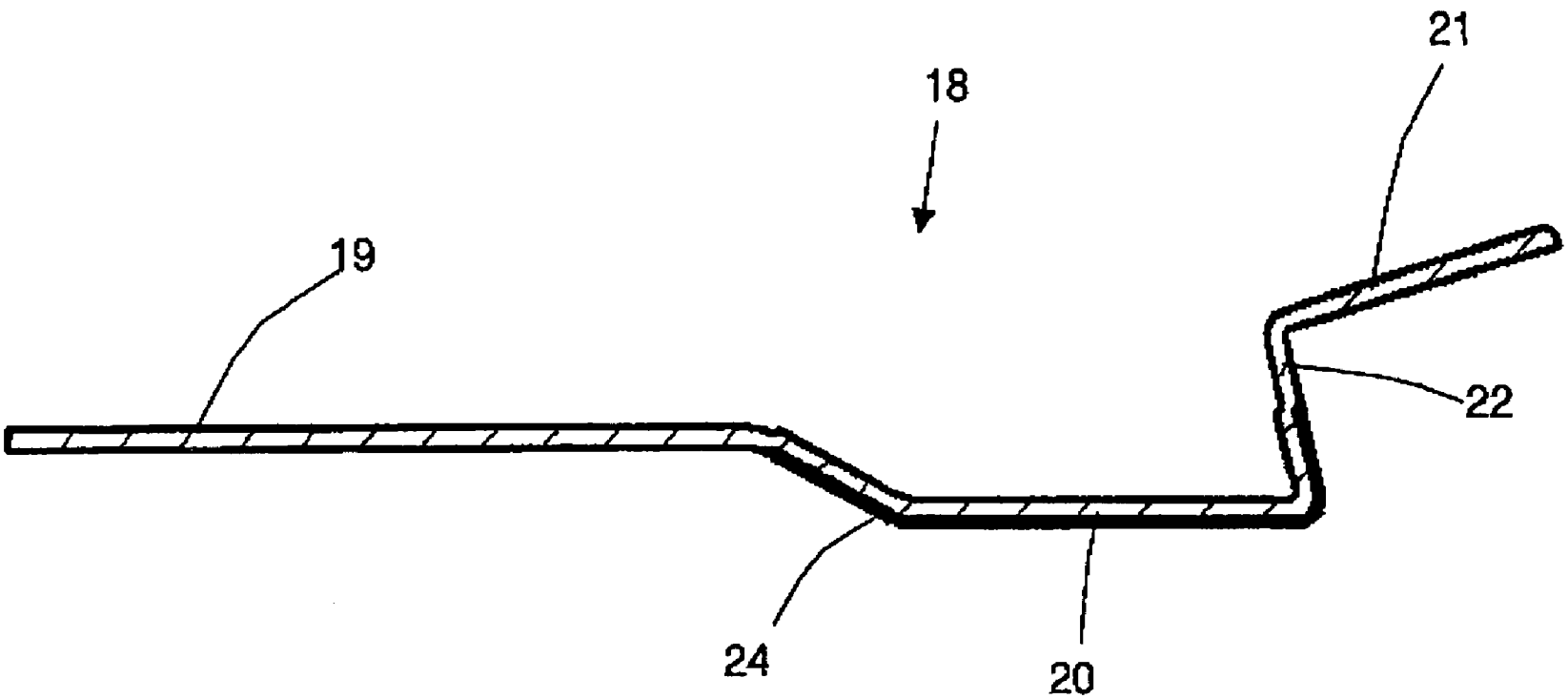
FIG. 6 a longitudinal sectional view through the retaining element.

Furthermore, a retaining element 18 is provided which is shown in FIGS. 5 and 6 as an individual element and which is made from a material, having a high strength and good elastic characteristics, especially from a non-corrosive steel. This retaining element 18 comprises a pin-reinforcement portion 19, which is formed flat and is especially visible in FIG. 3. The pin-reinforcement portion is securely received between the two pin portions 17*a* and 17*b*. It reinforces the flat terminal pin 16 because of its higher strength in relation to the material, from which the pin portions 17*a*, 17*b* are manufactured. At the same time the pin portions 17*a*, 17*b*, which are pressed together with the pin-reinforcement portion 19 of the retaining element 18, secure it in its position. An intermediate portion 20, which is angled and then extends parallel to the bottom wall 7 of the base portion 4 follows integrally the pin-reinforcement portion 19, i.e. follows the transition contour of the base element 1 towards the base portion 4. To this intermediate portion 20 a first angled portion 22 is connected, to which again a further retaining portion 21 follows in an angled manner, which ends in the support edge 23.

The transitional area between the intermediate portion 20 and the first angled portion 22 is provided with a bead 24 for stiffening the same. As especially visible from FIGS. 1 to 4 and especially from FIG. 3, the intermediate portion 20 is held in abutment to the inner face 13 of the bottom wall 7 by means of the retaining tabs 10, 11, so that a sufficient stiffening (reinforcement) is achieved. Furthermore, the retaining element 18 is held against withdrawal by the retaining lance 14 punched out of the bottom wall 14 and projecting into the space 12. The bending edge of the second angling of the retaining portion 21 is arranged in the area of the support tab 15, so that a good support base is achieved when withdrawal forces act along the longitudinal axis X in the direction towards the conductor contact portion 2. The retaining portion 21 is angled in such a way, that its support edge 23 projects over the upper wall 4 through the opening 6 to the outside, to be supported against a corresponding housing edge of a connector housing (not shown) in the assembled condition.

What is claimed is:

1. An electrical contact element, comprising:

a base element (1) formed from a flat material with a high electrical conductivity, the base element including:

a conductor contact portion (2), a base portion (4) integrally connected to the conductor contact portion (2) and formed box-like defined by an upper wall (5) with an opening (6), a bottom wall (7) opposite to the upper wall (5) and two side walls (8, 9) connecting the upper wall (5) and the bottom wall (7), and a flat terminal pin (16), integrally connected to the base portion (4) and extending away from the conductor contact portion (2) and comprising two vertically arranged pin portions (17*a*, 17*b*); and an elastic retaining element (18) formed from a sheet spring steel which is independent of said flat material making up said base element and including:

a flat pin-reinforcement portion (19) arranged between the two pin portions (17*a*, 17*b*) such that the reinforcement portion is sandwiched along an entire length thereon by the two pin portions, an intermediate portion (20) extending from the pin-reinforcement portion (19) and abutting an inner side of the bottom wall (7), and an elastic retaining portion (21) angled relative to the intermediate portion (20) and projecting out of the opening (6) and forming a support edge (23).

2. Electrical contact element according to claim 1, wherein the two side walls (8, 9) connected, respectively, to both sides of the bottom wall (7) of the base portion (4) are respectively provided with a retaining tab (10, 11) projecting therefrom, wherein the retaining tabs (10, 11) project into the space (12) delimited by the bottom wall (7), the side walls (8, 9) and the upper wall (5) and engage over the intermediate portion (20) of the retaining element (18) which intermediate portion (20) abuts the inner face (13) of the bottom wall (7).

3. Electrical contact element according to claim 1, wherein the base element (1) is made from a copper material.

4. Electrical contact element according to claim 1, wherein the retaining element (18) is made from a non-corrosive steel with a high strength.

5. Electrical contact element according to claim 1, wherein the retaining element (18) is angled following the pin-reinforcement portion (19) in the direction towards the upper wall (5) and is again angled thereto in the area of the opening (6), so that the support edge (23) of the retaining portion (21) projects outwards beyond the upper wall (5).

6. Electrical contact element according to claim 5, further comprising a retaining lance (14) punched out of the bottom wall (7), which is arranged opposite to the first angled portion (22) extending in the direction towards the upper wall (5).

7. Electrical contact element according to claim 5, wherein the upper wall (5) has a support tab (15) projecting into the space (12) delimited by this upper wall (5), the side walls (8, 9) and the bottom wall (7).

8. Electrical contact element according to claim 5, wherein the retaining element (18) is provided in the area of the intermediate portion (20) and of the first angled portion (22) with a bead (24).

9. An electrical contact element, comprising:

a base element (1) formed from a flat material with a high electrical conductivity, the base element including:

a conductor contact portion (2), a base portion (4) integrally connected to the conductor contact portion (2) and formed box-like defined by an upper wall (5) with an opening (6), a bottom wall (7) opposite to the upper wall (5) and two side walls (8, 9) connecting the upper wall (5) and the bottom wall (7), and a flat terminal pin (16), integrally connected to the base portion (4) and extending away from the conductor contact portion (2) and comprising two vertically arranged pin portions (17*a*, 17*b*); and an elastic retaining element (18) formed from a sheet spring steel and including:

a flat pin-reinforcement portion (19) arranged between the two pin portions (17*a*, 17*b*), an intermediate portion (20) extending from the pin-reinforcement portion (19) and abutting an inner side of the bottom wall (7), and an elastic retaining portion (21) angled relative to the intermediate portion (20) and projecting out of the opening (6) and forming a support edge (23), wherein the two side walls (8, 9) connected, respectively, to both sides of the bottom wall (7) of the base portion (4) are respectively provided with a retaining tab (10, 11) projecting therefrom, wherein the retaining tabs (10, 11) project into the space (12) delimited by the bottom wall (7), the side walls (8, 9) and the upper wall (5) and engage over the intermediate portion (20) of the retaining element (18) which intermediate portion (20) abuts the inner face (13) of the bottom wall (7).

10. An electrical contact element, comprising:

a base element (1) formed from a flat material with a high electrical conductivity, the base element including:

a conductor contact portion (2), a base portion (4) integrally connected to the conductor contact portion (2) and formed box-like defined by an upper wall (5) with an opening (6), a bottom wall (7) opposite to the upper wall (5) and two side walls (8, 9) connecting the upper wall (5) and the bottom wall (7), and a flat terminal pin (16), integrally connected to the base portion (4) and extending away from the conductor contact portion (2) and comprising two vertically arranged pin portions (17*a*, 17*b*); and an elastic retaining element (18) formed from a sheet spring steel and including:

a flat pin-reinforcement portion (19) arranged between the two pin portions (17*a*, 17*b*), an intermediate portion (20) extending from the pin-reinforcement portion (19) and abutting an inner side of the bottom wall (7), and an elastic retaining portion (21) angled relative to the intermediate portion (20) and projecting out of the opening (6) and forming a support edge (23), wherein the retaining element (18) is angled following the pin-reinforcement portion (19) in the direction towards the upper wall (5) and is again angled thereto in the area of the opening (6), so that the support edge (23) of the retaining portion (21) projects outwards beyond the upper wall (5), and wherein the upper wall (5) has a support tab (15) projecting into the space (12) delimited by this upper wall (5), the side walls (8, 9) and the bottom wall (7).

11. An electrical contact element, comprising:

a base element (1) formed from a flat material with a high electrical conductivity, the base element including:

a conductor contact portion (2), a base portion (4) integrally connected to the conductor contact portion (2) and formed box-like defined by an upper wall (5) with an opening (6), a bottom wall (7) opposite to the upper wall (5) and two side walls (8, 9) connecting the upper wall (5) and the bottom wall (7), and a flat terminal pin (16), integrally connected to the base portion (4) and extending away from the conductor contact portion (2) and comprising two vertically arranged pin portions (17*a*, 17*b*); and an elastic retaining element (18) formed from a sheet spring steel and including:

a flat pin-reinforcement portion (19) arranged between the two pin portions (17*a*, 17*b*), an intermediate portion (20) extending from the pin-reinforcement portion (19) and abutting an inner side of the bottom wall (7), and an elastic retaining portion (21) angled relative to the intermediate portion (20) and projecting out of the opening (6) and forming a support edge (23), and wherein the retaining element (18) is made from a non-corrosive steel with a high strength.

* * * * *